US010314416B2

(12) United States Patent
Kim et al.

(10) Patent No.: US 10,314,416 B2
(45) Date of Patent: Jun. 11, 2019

(54) GOODS SUPPORTING DEVICE

(71) Applicant: LIVEWORK Co., Ltd., Seoul (KR)

(72) Inventors: Pil Won Kim, Seoul (KR); Bo Ram Lee, Seoul (KR); Woo Yeol Park, Incheon (KR)

(73) Assignee: LIVEWORK Co., Ltd., Seoul (KR)

( * ) Notice: Subject to any disclaimer, the term of this patent is extended or adjusted under 35 U.S.C. 154(b) by 0 days.

(21) Appl. No.: 15/627,523

(22) Filed: Jun. 20, 2017

(65) Prior Publication Data

US 2017/0360225 A1 Dec. 21, 2017

(30) Foreign Application Priority Data

Jun. 20, 2016 (KR) ..... 20-2016-0003447 U

(51) Int. Cl.
*A47G 1/14* (2006.01)
*A47G 1/06* (2006.01)

(52) U.S. Cl.
CPC ..... *A47G 1/143* (2013.01); *A47G 1/06* (2013.01); *A47G 2001/0677* (2013.01)

(58) Field of Classification Search
CPC ..... A47G 2001/0688; A47G 1/141
USPC ..... 40/748, 750, 752, 754, 781, 784, 785
See application file for complete search history.

(56) References Cited

U.S. PATENT DOCUMENTS 2,647,834 A * 8/1953 Rabkin ..... A47G 1/141 40/753
4,609,206 A * 9/1986 O'Brien ..... B42F 13/402 281/27.2
7,284,739 B2 * 10/2007 Yasuki ..... A47G 1/143 248/457
8,985,633 B2 * 3/2015 Bodziak ..... A45C 11/18 281/21.1
2002/0133995 A1 * 9/2002 Cress ..... A47G 1/065 40/748
2008/0010887 A1 * 1/2008 Goldman ..... A47G 1/065 40/781
2009/0119965 A1 * 5/2009 Broehl ..... A47G 1/06 40/721
2013/0258586 A1 * 10/2013 Shao ..... A45C 11/00 361/679.55
2015/0305522 A1 * 10/2015 Yu ..... A47G 1/0633 40/777

* cited by examiner

*Primary Examiner* — Kristina N Junge
(74) *Attorney, Agent, or Firm* — Hauptman Ham, LLP

(57) ABSTRACT

A goods supporting device is disclosed. The goods supporting device includes a body having a plate shape, and a support frame configured to have a shape corresponding to the body and support the body to stand the body while the support frame is combined with the body. Here, a folding part to be folded is formed to the support frame, and the support frame includes a fixing area and a folding area separated based on the folding part. The fixing area is fixed by the body with combined with the body and the folding area is folded while the fixing area is fixed.

12 Claims, 11 Drawing Sheets

GOODS SUPPORTING DEVICE

PRIORITY

This application claims priority under 35 U.S.C. § 119(a) to a Korean patent application filed on Jun. 20, 2016 in the Korean Intellectual Property Office and assigned Serial No. 20-2016-0003447, the entire disclosure of which is incorporated herein by reference.

TECHNICAL FIELD

The present disclosure relates to a goods supporting device.

BACKGROUND ART

Generally, a picture frame includes a frame, of which a space where a photograph or a picture, etc. can be inserted is formed at a center part and a backboard for supporting the inserted photograph or picture, etc. The picture frame further includes a fixing member for fixing the backboard to the frame. In the event of changing the photograph or the picture in the conventional picture frame, the backboard is separated from the frame by controlling the fixing member, and the exiting photograph or picture is separated from the frame. Subsequently, new photograph or picture is inserted into the space of the frame, the backboard is disposed to support the new photograph or picture, and then the backboard is tightened by using the fixing member. Accordingly, it is not easy to change the photograph or the picture.

Generally, the picture frame used to be stood on the ground or the table or used to be adhered to wall, etc. In the event that the picture frame is stood on the ground or the table, it may be stood under the condition that it is supported by the ground through a support. In the event that the picture frame is adhered to the wall, etc., it includes a magnet or a ring. For example, in the event that the magnet is formed on a rear side of the picture frame, the magnet is adhered to the wall made up of material to which the magnet is adhered. The picture frame having the ring may be hung on a rack fixed to the wall.

SUMMARY

Accordingly, the invention is provided to substantially obviate one or more problems due to limitations and disadvantages of the related art. One embodiment of the invention provides a goods supporting device capable of be simply installed with various shapes while supporting stably goods, when the goods such as a picture frame is stood on the ground or the table.

In one embodiment, the invention provides a goods supporting device comprising: a body having a plate shape; and a support frame configured to have a shape corresponding to the body and support the body to stand the body while the support frame is combined with the body. Here, a folding part to be folded is formed to the support frame, and the support frame includes a fixing area and a folding area separated based on the folding part. The fixing area is fixed by the body with combined with the body and the folding area is folded while the fixing area is fixed.

At least one combination projection is formed to one of the body and the support frame, a combination groove corresponding to the combination projection is formed to the other, and the body is combined with the support frame by inserting the combination projection into the combination groove.

Thickness of the folding part is smaller than that of the other area of the support frame so that the support frame is folded by limited angle.

The body and the support frame have a square shape, and the fixing area is vertically or horizontally with the body so that the folding area is vertically or horizontally folded.

The support frame has a square shape, and the folding part is diagonally formed in the support frame.

The body has a rectangular shape and the support frame is a rectangular ring. Here, the fixing area corresponds to one side of the rectangular ring, the folding area corresponds to the other sides of the rectangular ring, and the folding part is formed at a contact part of the one side and the other sides.

The support frame is a square ring. Here, the folding part is formed on a pair of facing sides of the square ring so that the support frame is horizontally or vertically folded.

The support frame is a square. Here, the folding part is formed on a line formed by connecting vertically a pair of facing sides of the square so that the support frame is horizontally or vertically folded.

The support frame is a square. Here, the folding part is formed on at least one line formed by connecting vertically a pair of facing sides of the square, so that the support frame is horizontally or vertically folded and an area of the fixing area is different from an area of the folding area.

The body is a picture frame including a front frame, into which a photograph is inserted, and a rear frame for supporting the inserted photograph while the rear frame is combined with the front frame.

At least one combination projection is formed to one of the front frame and the rear frame, a combination groove corresponding to the combination projection is formed to the other, and the front frame is combined with the rear frame according as the combination projection is inserted into the combination groove.

The front frame and the rear frame have a square shape, and the front frame is combined with the rear frame after the front frame into which the photograph is inserted is rotated according to vertical type photograph or horizontal type photograph.

Holes are formed to both end parts of the rear frame. Here, the hole is used for separating the front frame from the rear frame by pushing the front frame with a finger through the hole, when the front frame and the rear frame are combined.

One side of the front frame has an open structure so that the photograph is inserted in sliding through the one side, when the front frame is combined with the rear frame.

The rear frame has a rectangular shape where a horizontal length is higher than a vertical length, and bar type front frame is combined along a vertical direction to an upper part and a lower part of the rear frame. Here, a guide groove, into which the photograph is inserted, is formed between the front frame and the rear frame when the front frame is combined with the rear frame.

The body includes a front frame into which a photograph is inserted. Here, a pair of picture hanging parts is formed at both end parts of a space into which the photograph is inserted, to fix the photograph.

Each of the picture hanging parts formed at both end parts has a double structure to fix different size of photographs. Here, a width between the picture hanging parts 123 differs due to the double structure.

The goods supporting device of the invention may be simply installed with various shapes while supporting stably goods, when the goods such as a picture frame is stood on the ground or the table.

BRIEF DESCRIPTION OF DRAWINGS

Example embodiments of the present invention will become more apparent by describing in detail example embodiments of the present invention with reference to the accompanying drawings, in which.

DETAILED DESCRIPTION

In the present specification, an expression used in the singular encompasses the expression of the plural, unless it has a clearly different meaning in the context. In the present specification, terms such as "comprising" or "including," etc., should not be interpreted as meaning that all of the elements or operations are necessarily included. That is, some of the elements or operations may not be included, while other additional elements or operations may be further included. Also, terms such as "unit," "module," etc., as used in the present specification may refer to a part for processing at least one function or action and may be implemented as hardware, software, or a combination of hardware and software.

Hereinafter, various embodiments of the invention will be described in detail with reference to accompanying drawings.

Figure 1:
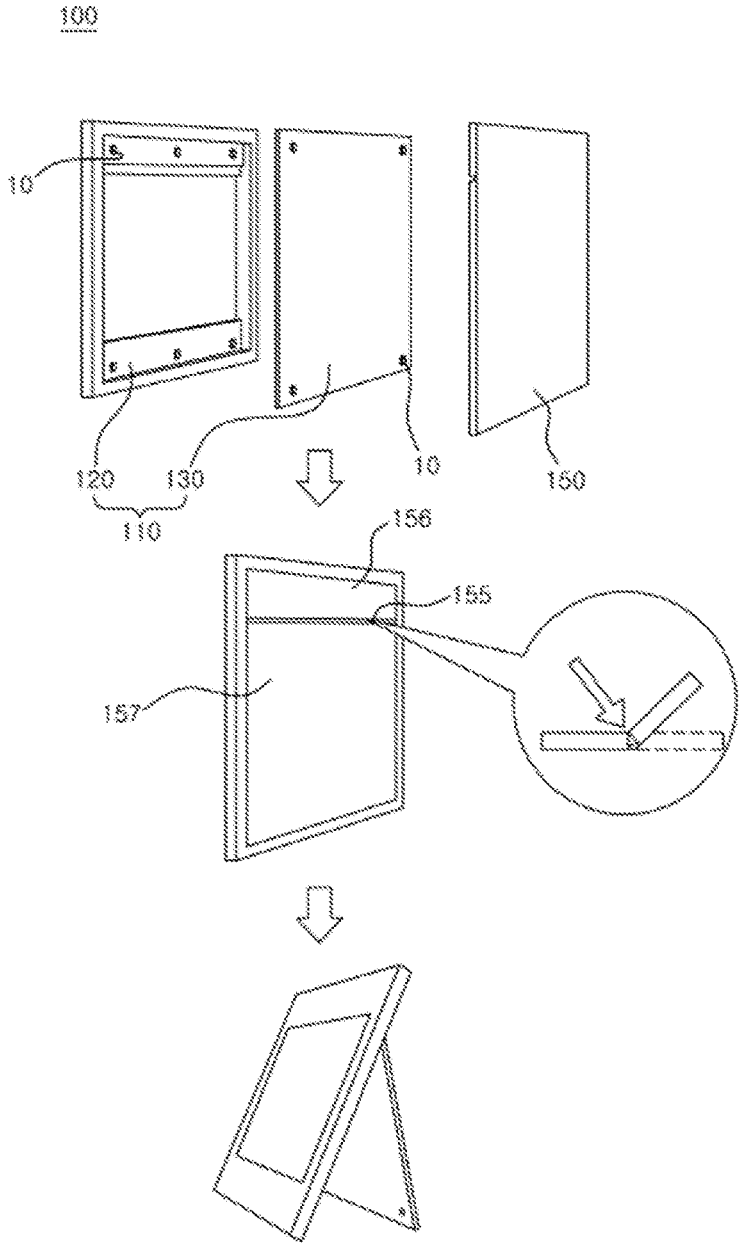
FIG. 1 is a view illustrating a goods supporting device according to a first embodiment of the invention.

FIG. 1 is a view illustrating a goods supporting device according to a first embodiment of the invention.

In FIG. 1, the goods supporting device 100 of the present embodiment may include a body 110 and a support frame 150. Here, the body 110 may be for example a table picture frame, a table clock device, etc. Hereinafter, it is assumed that the body 110 is the picture frame.

The body 110 may include a front frame 120 and a rear frame 130 as shown in FIG. 1.

The front frame 120 includes a space into which a photograph is inserted. The rear frame 130 is combined with the front frame 120 after the photograph is inserted into the front frame 120, and thus the photograph inserted into the front frame 120 is supported by the rear frame 130. Here, combination projections 10 and corresponding combination grooves 20 as fixing members are formed to the front frame 120 and the rear frame 130, to combine the front frame 120 with the rear frame 130. For example, the front frame 120 and the rear frame 130 may be combined by inserting the combination projections 10 of the front frame 120 into the combination grooves 20 of the rear frame 130.

The support frame 150 is combined with the body 110 by using a combination projection 10 and a combination groove 20, like combination of the front frame 120 and the rear frame 130 through the combination projection 10 and the combination groove 20.

For example, the combination projections 10 are formed on the other side opposed to a side combined with the front frame 120 of the rear frame 130, and the combination grooves 20 are formed on the support frame 150.

A folding part 155 is formed on the support frame 150 so that the support frame 150 can be folded. For example, as shown in FIG. 1, thickness of the folding part 155 is smaller than that of the other parts, and so the support frame 150 may be easily folded by only limited angle (preset angle). That is, the support frame 150 may include a fixing area 156 and a folding area 157 separated based on the folding part 155. The support frame 150 is not any folded if ends of the areas 156 and 157 meet based on the folding part 155 according as the support frame 150 is folded. Here, the fixing area 156 is an area where the combination groove 20 combined with the combination projection 10 of the rear frame 130 is formed. The support frame 150 may be fixed by combined with the rear frame 130 through combination of the combination projection 10 and the combination groove 20. The folding area 157 is folded by the limited angle while the fixing area 156 is fixed to the rear frame 130. Accordingly, the body 110 may be supported by the support frame 150 when the goods supporting device 100 is stood on the ground or the table.

Figure 2:
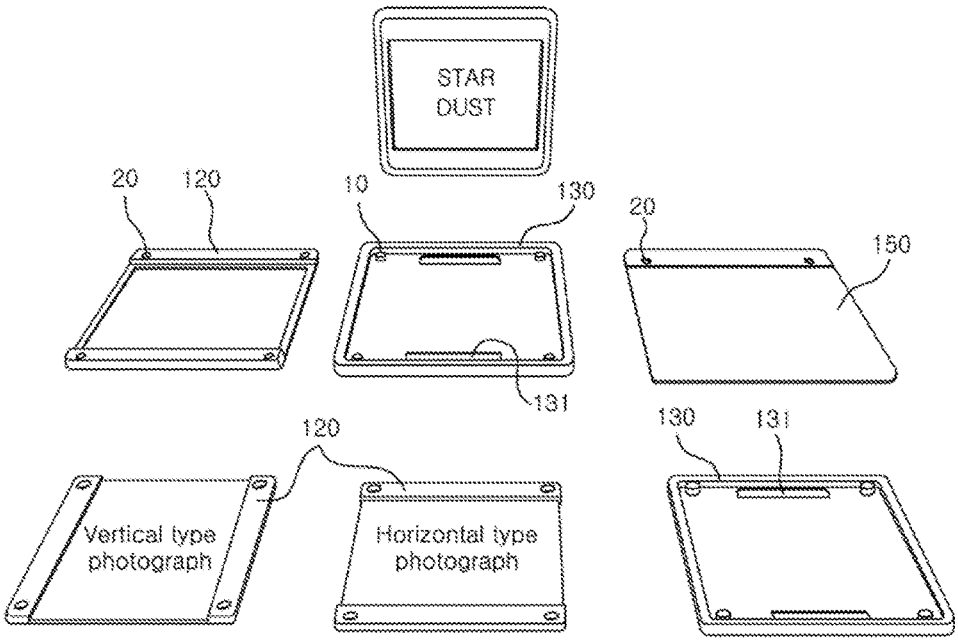
FIG. 2 and FIG. 3 are views illustrating a goods supporting device according to a second embodiment of the invention.
Figure 3:
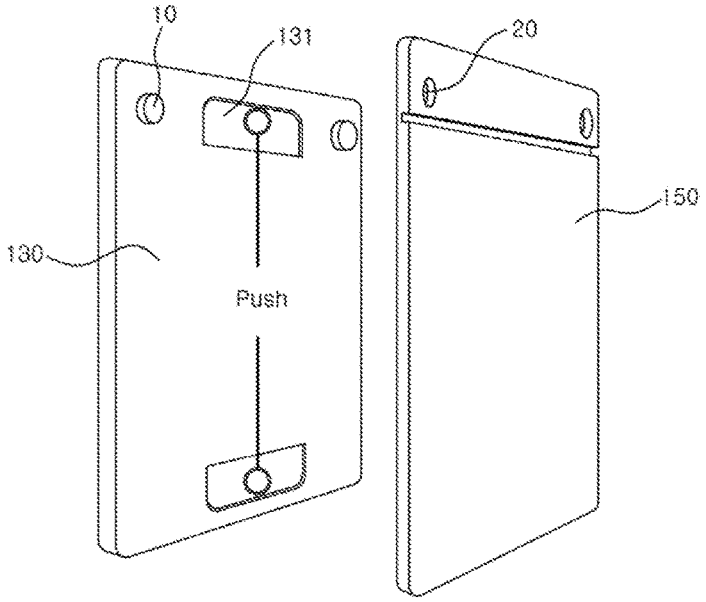

FIG. 2 and FIG. 3 are views illustrating a goods supporting device according to a second embodiment of the invention.

In FIG. 2, the goods supporting device 100 of the present embodiment includes a rear frame 120 having a space into which a front frame 120 is inserted, unlike the goods supporting device 100 of the first embodiment. In the first embodiment, the front frame 120 has the space into which the rear frame 130 is inserted. Accordingly, in the goods supporting device 100 of the second embodiment, combination projections 10 are formed to the rear frame 130, and combination grooves 20 are formed to the front frame 120.

The goods supporting device 100 shown in FIG. 2 and FIG. 3 has a square shape. The front frame 120 into where the photograph is inserted rotates depending on vertical type photograph or horizontal type photograph, and then it may be combined with the rear frame 130.

A pair of holes 131 is formed at both end parts of the rear frame 130. The holes 131 may be used for separating the front frame 120 from the rear frame 130 by a user pushing the front frame 120 with his finger through them, when the front frame 120 and the rear frame 130 are combined as shown in FIG. 3.

Figure 4:
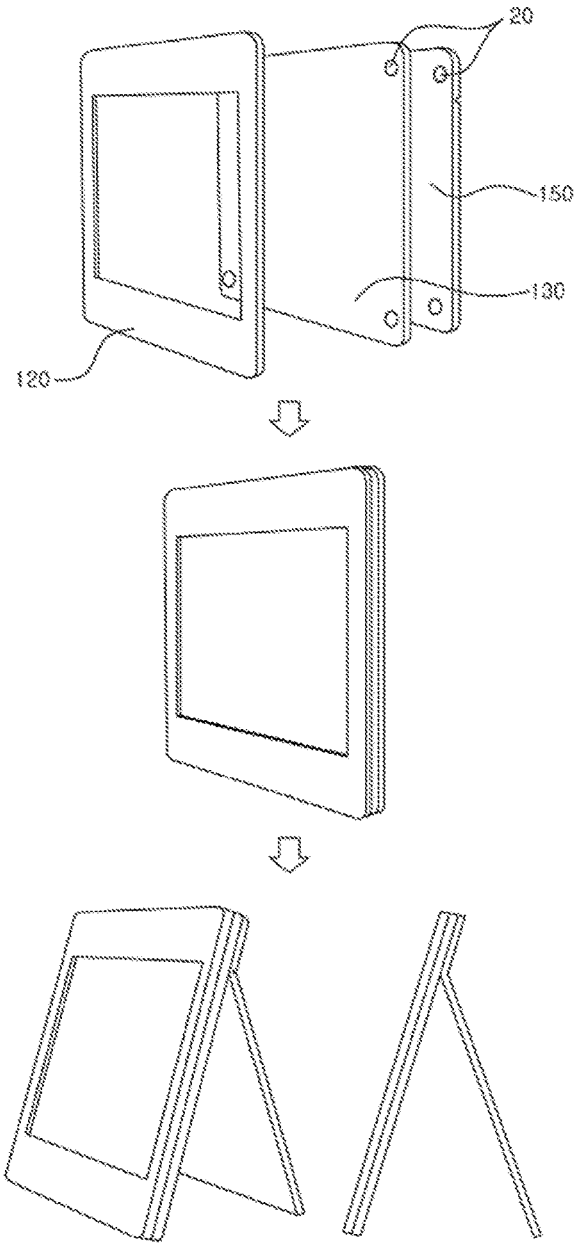
FIG. 4 and FIG. 5 are views illustrating a goods supporting device according to a third embodiment of the invention.
Figure 5:
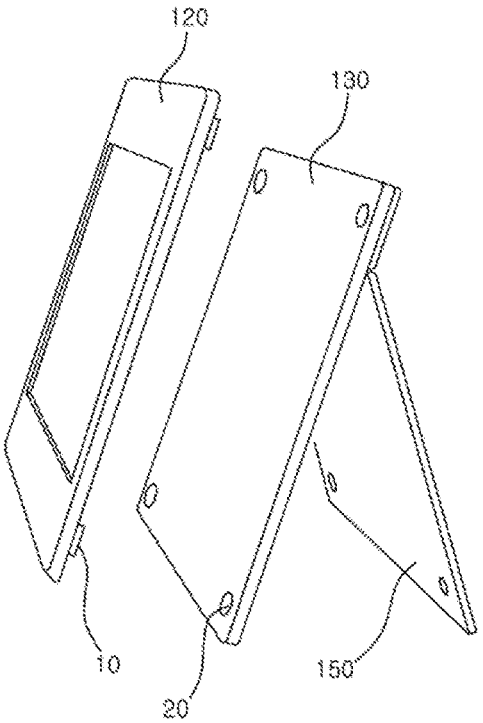

FIG. 4 and FIG. 5 are views illustrating a goods supporting device according to a third embodiment of the invention.

In FIG. 4, unlike in the first embodiment and the second embodiment, a front frame 120 and a rear frame 130 of the goods supporting device 100 of the present embodiment have the same size of square shape. As shown in FIG. 5, the front frame 120 and the rear frame 130 may be assembled through combination of combination projections 10 and combination holes 20 respectively formed to the front frame 120 and the rear frame 130.

That is, a user may be easily detachable only the front frame 120, while the front frame 120, the rear frame 130 and a support frame 150 are combined.

Figure 6:
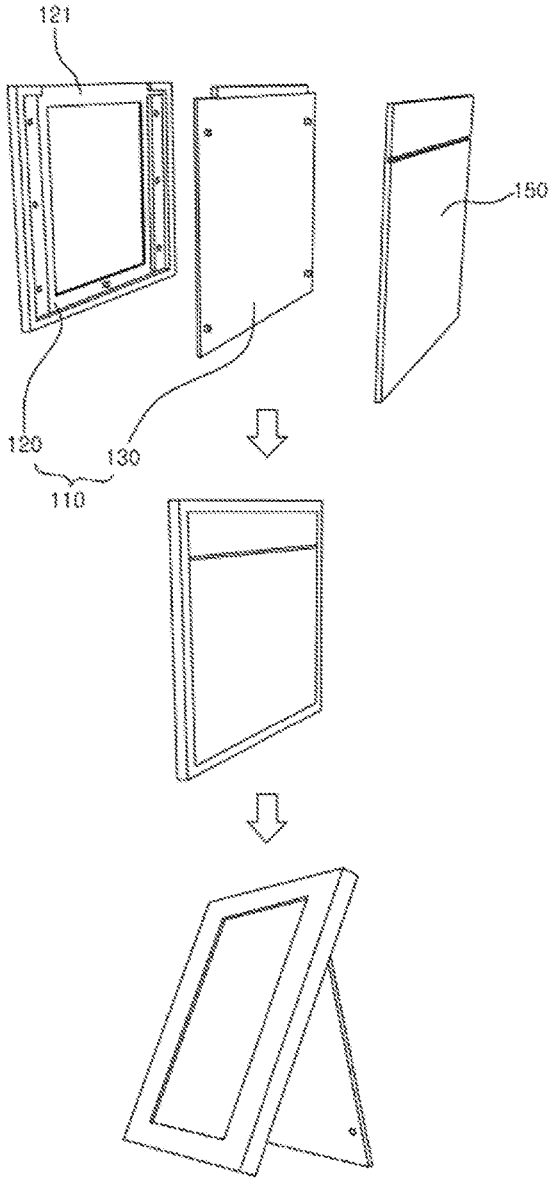
FIG. 6 and FIG. 7 are views illustrating a goods supporting device according to a fourth embodiment of the invention.
Figure 7:
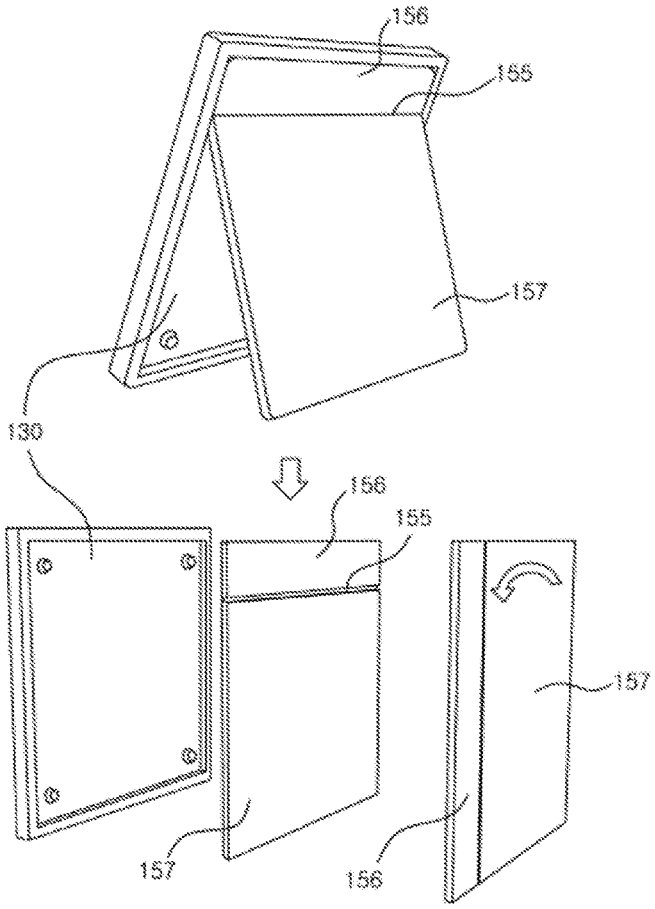

FIG. 6 and FIG. 7 are views illustrating a goods supporting device according to a fourth embodiment of the invention.

In FIG. 6, in the goods supporting device 100 of the present embodiment, one side of a front frame 120 has an open structure 121 so that a photograph can be inserted in sliding via the open structure 121 when the front frame 120 is combined with a rear frame 130.

A fixing area 156 of a support frame 150 may be combined with the rear frame 130 as shown in FIG. 7 so that a folding area 157 of the support frame 150 can be vertically or horizontally folded. For example, the goods supporting device 100 may have a square shape, combination projections 10 may be formed at each of corner parts of the rear frame 130, and a pair of combination grooves 20 may be formed at both end parts of a fixing area 156 of the support frame 150. The combination grooves 20 of the fixing areas 156 may be combined with two of four combination projections 10 of the rear frame 130, and thus the folding area 157 of the support frame 150 may be vertically or horizontally folded.

Figure 8:
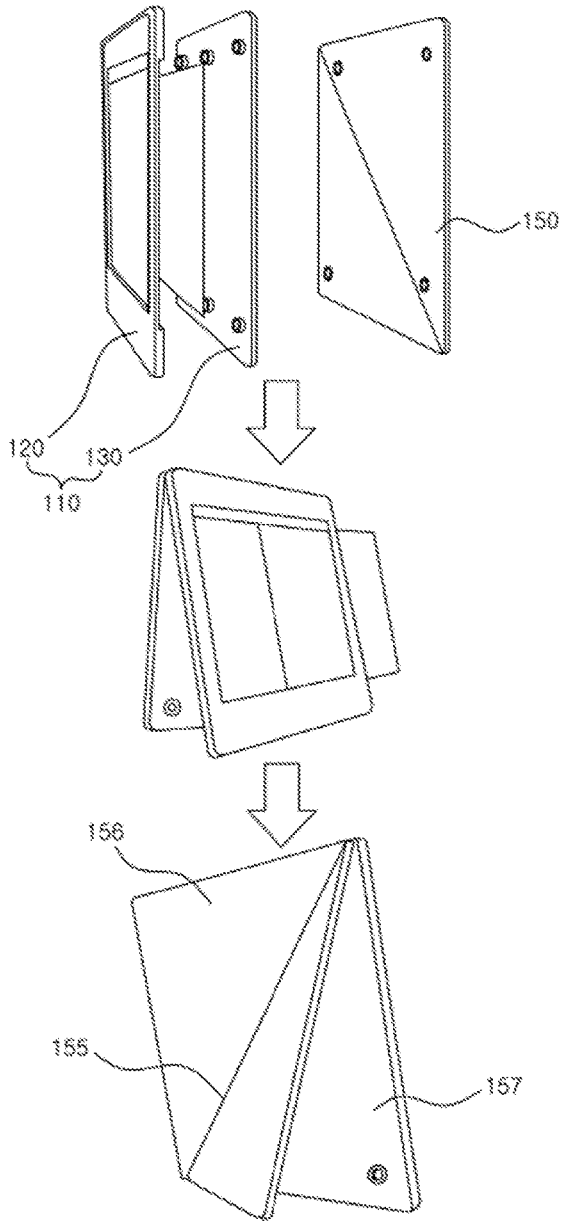
FIG. 8 is a view illustrating a goods supporting device according to a fifth embodiment of the invention.

FIG. 8 is a view illustrating a goods supporting device according to a fifth embodiment of the invention.

In FIG. 8, the goods supporting device 100 of the present embodiment includes a front frame 120 of which a photograph is inserted in sliding into a side, like in the fourth embodiment.

A folding part 155 of a support frame 150 is diagonally formed. As a result, a fixing area 156 and a folding area 157 may have the same shape and size, and the goods supporting device 100 may be horizontally or vertically stood based on horizontal type photograph or vertical type photograph.

Figure 9:
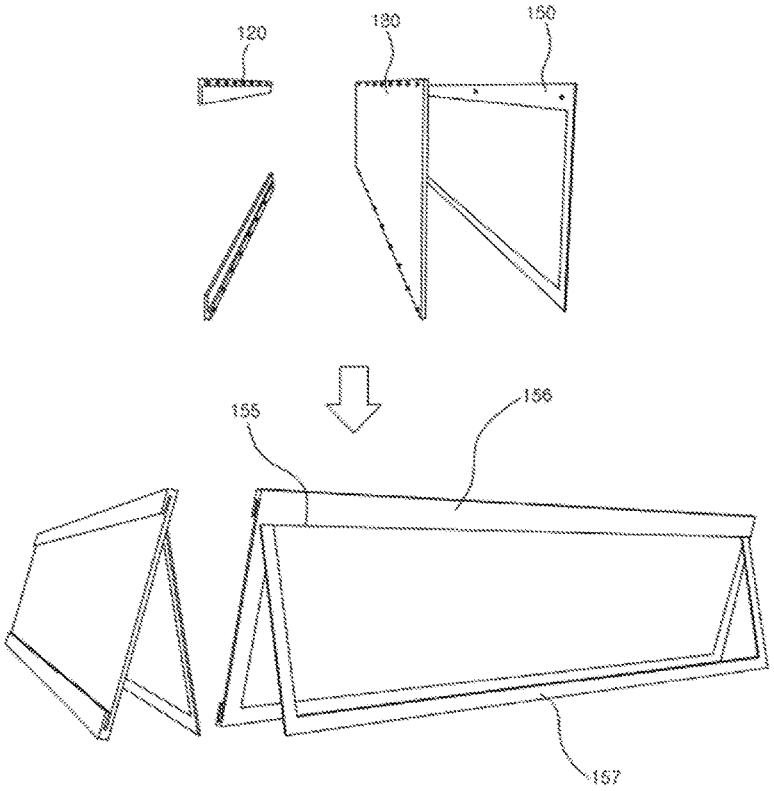
FIG. 9 is a view illustrating a goods supporting device according to a sixth embodiment of the invention.

FIG. 9 is a view illustrating a goods supporting device according to a sixth embodiment of the invention.

In FIG. 9, the goods supporting device 100 of the present embodiment has a rectangular shape where horizontal length is higher than vertical length.

Bar type front frames 120 are combined along a vertical direction to an upper part and a lower part of a rear frame 130 having rectangular shape, and a support frame 150 is combined with a rear side of the rear frame 130. In this case, a guide groove (not shown), into which a photograph is inserted, is formed between the front frame 120 and the rear frame 130, when the front frame 120 is combined with the rear frame 130.

The support frame 150 has a rectangular ring shape corresponding to the rear frame 130 as shown in FIG. 9. A fixing area 156 corresponds to one side of the rectangular ring, and a folding area 157 corresponds to the other sides, i.e. "ㄷ" area of the rectangular ring. Accordingly, the folding part 155 may be formed at a contact part of the one side and the 'ㄷ' area of the rectangular ring.

Figure 10:
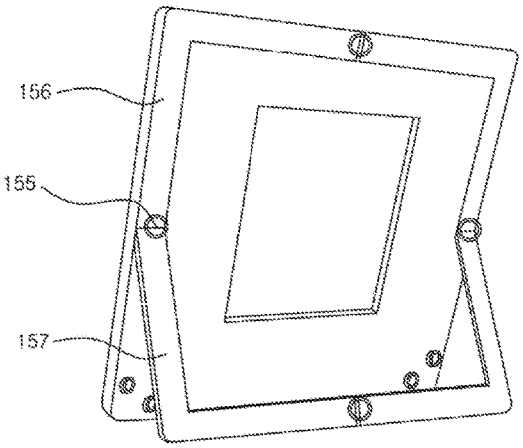
FIG. 10 to FIG. 12 are views illustrating a goods supporting device according to a seventh embodiment to a ninth embodiment of the invention.
Figure 11:
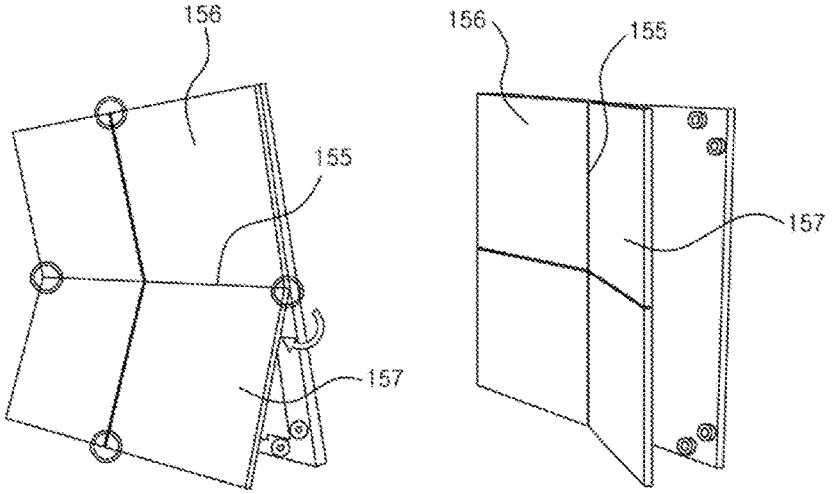
Figure 12:
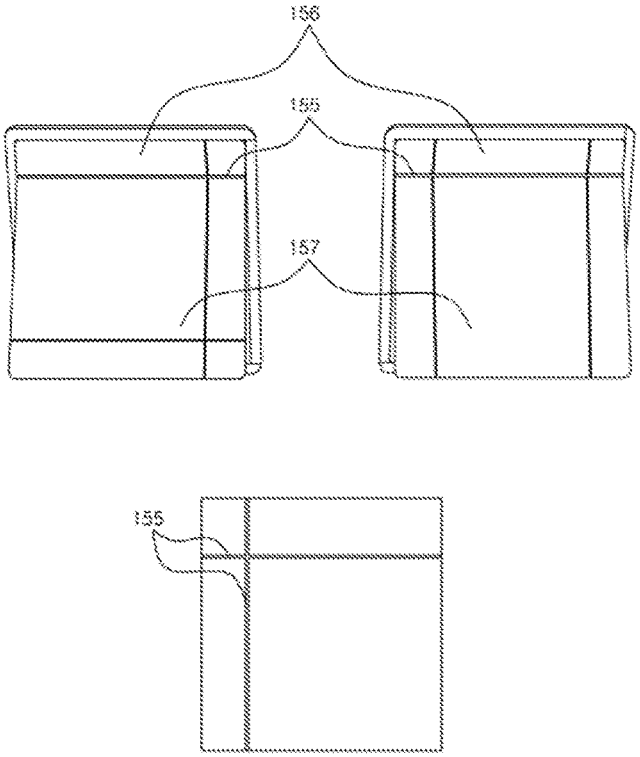

FIG. 10 to FIG. 12 are views illustrating a goods supporting device according to a seventh embodiment to a ninth embodiment of the invention.

In FIG. 10, a support frame 150 of the goods supporting device 100 of the seventh embodiment has a square ring shape. A folding part 155 is formed on a pair of facing sides of the square ring so that the support frame 150 is horizontally and vertically folded.

In FIG. 11, a support frame 150 of the goods supporting device 100 of the eighth embodiment has a square shape. A folding part 155 is formed on a line formed by connecting a pair of facing sides of the square so that the support frame 150 can be horizontally or vertically folded.

The folding part 155 of the support frame 150 of the seventh embodiment and the eighth embodiment may be formed on a pair of facing sides of the square so that the fixing area 156 and the folding area 157 have the same area.

In FIG. 12, a support frame 150 of the goods supporting device 100 of the ninth embodiment has a square shape, like in the eighth embodiment (FIG. 11). A folding part 155 is formed on a line formed by connecting vertically a pair of facing sides of the square so that the support frame 150 can be horizontally or vertically folded.

As shown in FIG. 12, the support frame 150 of the goods supporting device 100 of the ninth embodiment may be formed on at least one line formed by connecting vertically a pair of facing sides of the square so that an area of a fixing area 156 is different from that of a folding area 157.

Figure 13:
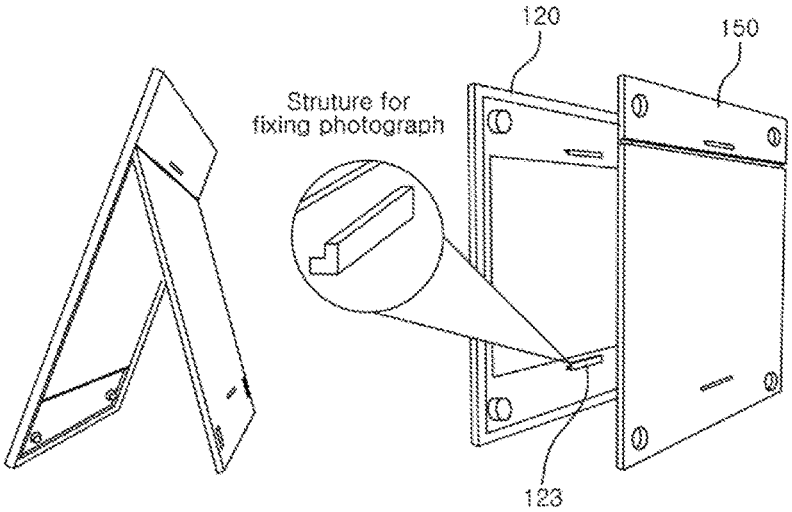
FIG. 13 is a view illustrating a goods supporting device according to a tenth embodiment of the invention.

FIG. 13 is a view illustrating a goods supporting device according to a tenth embodiment of the invention.

In FIG. 13, a body 110 of the goods supporting device 100 of the tenth embodiment includes only a front frame 120. Accordingly, the front frame 120 has a structure for fixing a photograph as shown in FIG. 13.

A pair of picture hanging parts 123 is formed at both end parts of a space into which the photograph is inserted, in the front frame 120. Each of the picture hanging parts 123 formed at both end parts of the space may have a double structure to fix different size of photographs, wherein width between the picture hanging parts 123 differs due to the double structure.

Figure 14:
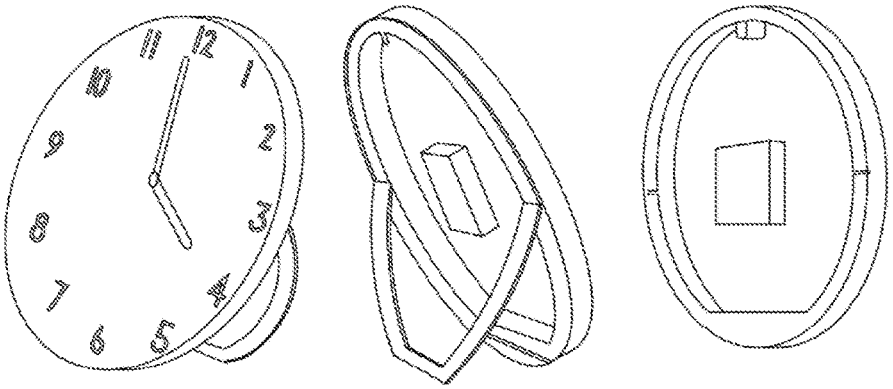
FIG. 14 and FIG. 15 are views illustrating examples of goods applying a supporting way of the goods supporting device of the invention.
Figure 15:
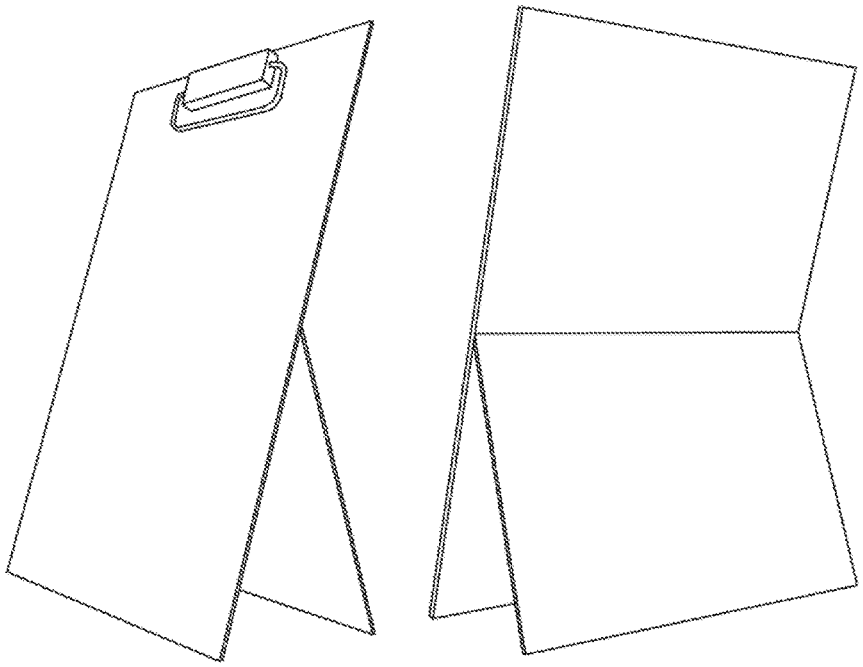

FIG. 14 and FIG. 15 are views illustrating examples of goods applying a supporting way of the goods supporting device of the invention.

Referring to FIG. 14 and FIG. 15, the structure of the support frame 150 described above may be adaptively applied to corresponding goods. FIG. 14 and FIG. 15 show examples of a clock and a clipboard to which the structure is applied. However, the supporting way of the goods supporting device of the invention may be applied to various goods such as a mirror, a calendar and so on.

Components in the embodiments described above can be easily understood from the perspective of processes. That is, each component can also be understood as an individual process. Likewise, processes in the embodiments described above can be easily understood from the perspective of components. The embodiments of the invention described above are disclosed only for illustrative purposes. A person having ordinary skill in the art would be able to make various modifications, alterations, and additions without departing from the spirit and scope of the invention, but it is to be appreciated that such modifications, alterations, and additions are encompassed by the scope of claims set forth below.

DESCRIPTION OF REFERENCE NUMBERS

100: goods supporting device
110: body
120: front frame
130: rear frame
150: support frame
155: folding part
156: fixing area
157: folding area

10: combination projection
20: combination groove

The invention claimed is:

1. A goods supporting device comprising:

a body having a plate shape; and a support frame having a shape corresponding to the body and combined with the body, the support frame comprising a plurality of folding parts, the plurality of folding parts configured to be folded and configured to support the body to be stood, wherein the support frame includes a fixing area and a folding area separated based on the plurality of folding parts, wherein the fixing area is fixed by the body and the folding area is folded while the fixing area is fixed, wherein the support frame is a square, wherein the plurality of folding parts comprises at least one first folding part and at least one second folding part, wherein the at least one first folding part formed on at least one horizontal line formed by connecting a pair of horizontal facing sides of the square and at least one second folding part formed on at least one vertical line formed by connecting a pair of vertical facing sides of the square, wherein a first fixing area of the support frame formed by a folding of one of the plurality of folding parts is different from a second fixing area formed by the remaining folding parts, wherein the support frame is configured to be horizontally folded by the at least one first folding part and to be vertically folded by the at least one second folding part, and wherein the body is free of folding by the plurality of folding parts.

2. The goods supporting device of claim 1, wherein at least one combination projection is formed to one of the body and the support frame, a combination groove corresponding to the at least one combination projection is formed to the other, and the body is combined with the support frame by inserting the at least one combination projection into the combination groove.

3. The goods supporting device of claim 1, wherein thickness of the plurality of folding parts is smaller than that of other areas of the support frame so that the support frame is folded by a predetermined angle.

4. The goods supporting device of claim 1, wherein the body and the support frame have a square shape, and the support frame is vertically or horizontally combined with the body so that the folding area is vertically or horizontally folded.

5. The goods supporting device of claim 1, wherein an area of the fixing area is different from an area of the folding area.

6. The goods supporting device of claim 1, wherein the body is a picture frame including a front frame, into which a photograph is inserted, and a rear frame for supporting the inserted photograph while the rear frame is combined with the front frame.

7. The goods supporting device of claim 6, wherein at least one combination projection is formed to one of the front frame and the rear frame, a combination groove corresponding to the at least one combination projection is formed to the other, and the front frame is combined with the rear frame according as the at least one combination projection is inserted into the combination groove.

8. The goods supporting device of claim 6, wherein the front frame and the rear frame have a square shape, and the front frame is configured to combine with the rear frame in horizontal or in vertical, according to vertical type photograph or horizontal type photograph.

9. The goods supporting device of claim 6, wherein holes are formed to an upper area and a lower area of the rear frame, and wherein the front frame is configured to be separated from the rear frame by pushing the front frame through the holes, when the front frame and the rear frame are combined.

10. The goods supporting device of claim 6, wherein one side of the front frame has an open structure so that the photograph is inserted in sliding through the one side, when the front frame is combined with the rear frame.

11. The goods supporting device of claim 6, wherein the rear frame has a rectangular shape where a horizontal length is longer than a vertical length, and the front frame comprises an upper frame and a lower frame, wherein the upper frame and lower frame of the front frame are combined along a vertical direction to an upper part and a lower part of the rear frame, respectively, and wherein a guide groove, into which the photograph is inserted, is formed between the front frame and the rear frame when the front frame is combined with the rear frame.

12. The goods supporting device of claim 1, wherein the body includes a front frame into which a photograph is inserted, and wherein a pair of picture hanging parts is formed at a space into which the photograph is inserted, and configured to fix the photograph.

* * * * *